US005463968A

United States Patent [19]

Abdulally

[11] Patent Number: 5,463,968

[45] Date of Patent: Nov. 7, 1995

[54] FLUIDIZED BED COMBUSTION SYSTEM AND METHOD HAVING A MULTICOMPARTMENT VARIABLE DUTY RECYCLE HEAT EXCHANGER

[75] Inventor: Iqbal F. Abdulally, Randolph, N.J.

[73] Assignee: Foster Wheeler Energy Corporation, Clinton, N.J.

[21] Appl. No.: 295,573

[22] Filed: Aug. 25, 1994

[51] Int. Cl.[6] ..... F23D 1/00

[52] U.S. Cl. ..... 110/347; 110/245; 122/4 D; 165/104.16; 422/145; 422/146

[58] Field of Search ..... 110/342, 345, 110/347, 204, 216, 245; 122/4 D; 165/104.16; 422/145, 146; 432/58

[56] References Cited

U.S. PATENT DOCUMENTS

| | | | |
|---|---|---|---|
| 3,893,426 | 7/1975 | Bryers . | |
| 4,017,422 | 4/1977 | Gappa et al. . | |
| 4,111,158 | 9/1978 | Reh et al. . | |
| 4,165,717 | 8/1979 | Reh et al. . | |
| 4,227,488 | 10/1980 | Stewart et al. . | |
| 4,338,283 | 7/1982 | Sakamoto et al. . | |
| 4,399,106 | 8/1983 | Ueda . | |
| 4,469,050 | 9/1984 | Korenberg . | |
| 4,594,967 | 6/1986 | Wolowodiuk . | |
| 4,617,877 | 10/1986 | Gamble . | |
| 4,665,864 | 5/1987 | Seshamani et al. . | |
| 4,682,567 | 7/1987 | Garcia-Mallol et al. . | |
| 4,686,939 | 8/1987 | Stromberg | 122/4 D |
| 4,694,758 | 9/1987 | Gorzegno et al. . | |
| 4,704,084 | 11/1987 | Liu et al. . | |
| 4,709,662 | 12/1987 | Rawdon et al. . | |
| 4,716,856 | 1/1988 | Beisswenger et al. . | |
| 4,761,131 | 8/1988 | Abdulally . | |
| 4,813,479 | 3/1989 | Wahlgren . | |
| 4,856,460 | 8/1989 | Wied et al. . | |
| 4,896,717 | 1/1990 | Campbell, Jr. et al. . | |
| 4,947,804 | 8/1990 | Abdulally . | |
| 4,969,930 | 11/1990 | Arpalahti . | |
| 5,133,943 | 7/1992 | Abdulally | 422/145 |

*Primary Examiner*—Denise L. Gromada
*Assistant Examiner*—Susanne C. Tinker
*Attorney, Agent, or Firm*—Marvin A. Naigur

[57] ABSTRACT

A fluidized bed combustion system and method in which a recycle heat exchanger is located adjacent the furnace section of the recycle heat exchanger. Heat exchange surfaces are provided in a compartment of the recycle heat exchanger for removing heat from the solids, and a bypass compartment is provided through which the solids directly pass to the furnace during start-up and low load conditions. The flow of solids between compartments is selectively controlled and an L-valve connects one of the compartments to the furnace section. Air is passed into the L-valve to promote the flow of the separated materials from the latter compartment to the furnace. The flow rate of the air is modulated to vary the duty of the recycle heat exchanger.

12 Claims, 2 Drawing Sheets

FLUIDIZED BED COMBUSTION SYSTEM AND METHOD HAVING A MULTICOMPARTMENT VARIABLE DUTY RECYCLE HEAT EXCHANGER

BACKGROUND OF THE INVENTION

This invention relates to a fluidized bed combustion system and a method of operating same and, more particularly, to such a system and method in which a multicompartment recycle heat exchanger is provided adjacent the furnace section of the system.

Fluidized bed combustion systems are well known and include a furnace section in which air is passed through a bed of particulate material, including a fossil fuel, such as coal, and a sorbent for the oxides of sulfur generated as a result of combustion of the coal, to fluidize the bed and to promote the combustion of the fuel at a relatively low temperature. These types of combustion systems are often used in steam generators in which water is passed in a heat exchange relationship to the fluidized bed to generate steam and permit high combustion efficiency and fuel flexibility, high sulfur adsorption and low nitrogen oxides emissions.

The most typical fluidized bed utilized in the furnace section of these type systems is commonly referred to as a "bubbling" fluidized bed in which the bed of particulate material has a relatively high density and a well-defined, or discrete, upper surface. Other types of systems utilize a "circulating" fluidized bed in which the fluidized bed density is below that of a typical bubbling fluidized bed, the fluidizing air velocity is equal to or greater than that of a bubbling bed, and the flue gases passing through the bed entrain a substantial amount of the fine particulate solids to the extent that they are substantially saturated therewith.

Circulating fluidized beds are characterized by relatively high internal and external solids recycling which makes them insensitive to fuel heat release patterns, thus minimizing temperature variations and, therefore, stabilizing the sulfur emissions at a low level. The high external solids recycling is achieved by disposing a cyclone separator at the furnace section outlet to receive the flue gases and the solids entrained thereby from the fluidized bed. The solids are separated from the flue gases in the separator and the flue gases are passed to a heat recovery area while the solids are recycled back to the furnace through a seal pot or seal valve. This recycling improves the efficiency of the separator, and the resulting increase in the efficient use of sulfur adsorbent and fuel residence times reduces the adsorbent and fuel consumption.

In the operation of these types of fluidized beds, and, more particularly, those of the circulating type, there are several important considerations. For example, the flue gases and entrained solids must be maintained in the furnace section at a substantially isothermal temperature (usually approximately 1600° F.) consistent with proper sulfur capture by the adsorbent. As a result, the maximum heat capacity (head) of the flue gases passed to the heat recovery area and the maximum heat capacity of the separated solids recycled through the cyclone and to the furnace section are limited by this temperature. In a cycle requiring only superheat duty and no reheat duty, the heat content of the flue gases at the furnace section outlet is usually sufficient to provide the necessary heat for use in the heat recovery area of the steam generator downstream of the separator. Therefore, the heat content of the recycled solids is not needed.

However, in a steam generator using a circulating fluidized bed with sulfur capture and a cycle that requires reheat duty as well as superheater duty, the existing heat available in the flue gases at the furnace section outlet is not sufficient. At the same time, heat in the furnace cyclone recycle loop is in excess of the steam generator duty requirements. For such a cycle, the design must be such that the heat in the recycled solids must be utilized before the solids are reintroduced to the furnace section.

To provide this extra heat capacity, a recycle heat exchanger is sometimes located between the separator solids outlet and the fluidized bed of the furnace section. The recycle heat exchanger includes superheater heat exchange surface and receives the separated solids from the separator and functions to transfer heat from the solids to the superheater surfaces at relatively high heat transfer rates before the solids are reintroduced to the furnace section. The heat from the superheater surfaces is then transferred to cooling circuits in the heat recovery area to supply the necessary reheat duty.

The simplest technique for controlling the amount of heat transfer in the recycle heat exchanger is to vary the level of solids therein. However, situations exist in which a sufficient degree of freedom in choosing the recycle bed height is not available, such as for example, when a minimum fluidized bed solids depth or pressure is required for reasons unrelated to heat transfer. In this case, the heat transfer may be controlled by utilizing "plug valves" or "L valves" for diverting a portion of the recycled solids so that they do not contact and become cooled by the recycle heat exchanger. The solids from the diverting path and from the heat exchanger path are recombined or each stream is directly routed to the furnace section to complete the recycle path. In this manner, the proper transfer of heat to the heat exchanger surface is achieved for the unit load existing. However, these type arrangements require the use of moving parts within the solids system and/or need external solids flow conduits with associated aeration equipment which adds considerable cost to the system.

In order to reduce these costs, a system has been devised that is disclosed in U.S. application Ser. No. 371,170 filed on Jun. 26, 1989 by the assignee of the present invention. According to this system, a recycle heat exchanger is provided for receiving the separated solids and distributing them back to the fluidized bed in the furnace section. The recycle heat exchanger is located externally of the furnace section of the system and includes an inlet chamber for receiving the solids discharged from the separators. Two additional chambers are provided which receive the solids from the inlet chamber. The solids are fluidized in the additional chambers and heat exchange surfaces are provided in at least one of the additional chambers for extracting heat from the solids. The solids in the additional chamber are permitted to flow into an outlet chamber when the level in the former chamber exceeds a predetermined height set by the height of an overflow weir. The solids entering the outlet chamber are then discharged back to the fluidized bed in the furnace section.

However, there are some disadvantages associated with this type of operation. For example, the space available for heat exchanger surfaces is limited, and pressure fluctuations in the furnace section are transmitted to the external heat exchanger which results in erratic performance. Also, the solids are directed from the heat exchanger through one discharge pipe to one relatively small area of the furnace section which is inconsistent with uniform mixing and distribution of the solids. Also, there is no provision for directly controlling the flow of solids between compartments. Further, this system relies on pressure differential to drive the solids from the heat exchanger to the furnace section which requires power. Still further, there is no provision for controlling the solids inventory, or furnace loading.

These problems are addressed in U.S. Pat. No. 5,133,943 which is assigned to the assignee of the present invention and which discloses a system including a recycle heat exchanger located adjacent the furnace section of the system. The flue gases and entrained particulate materials from the fluidized bed in the furnace section are separated, the flue gases are passed to a heat recovery area and the separated solids are passed to the recycle heat exchanger. Heat exchange surfaces are provided in one compartment of the heat exchanger for removing heat from the solids, and a bypass compartment is provided through which the solids directly pass to the furnace during start-up and low load conditions. A separate cooling compartment for the separated solids is disposed in the recycle heat exchange and means are provided to selectively control the flow of solids between compartments.

SUMMARY OF THE INVENTION

It is an object of the present invention to provide a fluidized bed combustion system and method which incorporates all of the features of the system of the above-identified patent while providing greater operational flexibility.

It is a further object of the present invention to provide a system and method of the above type which are applicable to either an atmospheric circulating fluidized bed or a pressurized circulating fluidized bed.

It is a further object of the present invention to provide a system and method of the above type in which a recycle heat exchanger is provided which includes heat exchange surface coupled either to steam or water circuitry in the boiler.

It is a further object of the present invention to provide a system and method of the above type in which a L-valve connects one of the compartments in the recycle heat exchanger to the furnace.

It is a further object of the present invention to provide a system and method of the above type in which the solids flow through the L-valve, and therefore the duty of the recycle heat exchanger, can be modulated.

Towards the fulfillment of these and other objects the system of the present invention includes a recycle heat exchanger located adjacent the furnace section of the system. The flue gases and entrained particulate materials from the fluidized bed in the furnace section are separated, the flue gases are passed to a heat recovery area and the separated solids are passed to the recycle heat exchanger. Heat exchange surfaces are provided in one compartment of the heat exchanger for removing heat from the solids, and a bypass compartment is provided through which the solids directly pass to the furnace during start-up and low load conditions. A separate cooling compartment for the separated solids is disposed in the recycle heat exchanger and means are provided to selectively control the flow of solids between compartments. An L-valve connects one of the compartments to the furnace and the solids flow through the L-valve can be modulated to vary the duty of the recycle heat exchanger.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawing wherein.

DESCRIPTION OF THE PREFERRED EMBODIMENT

Figure 1:
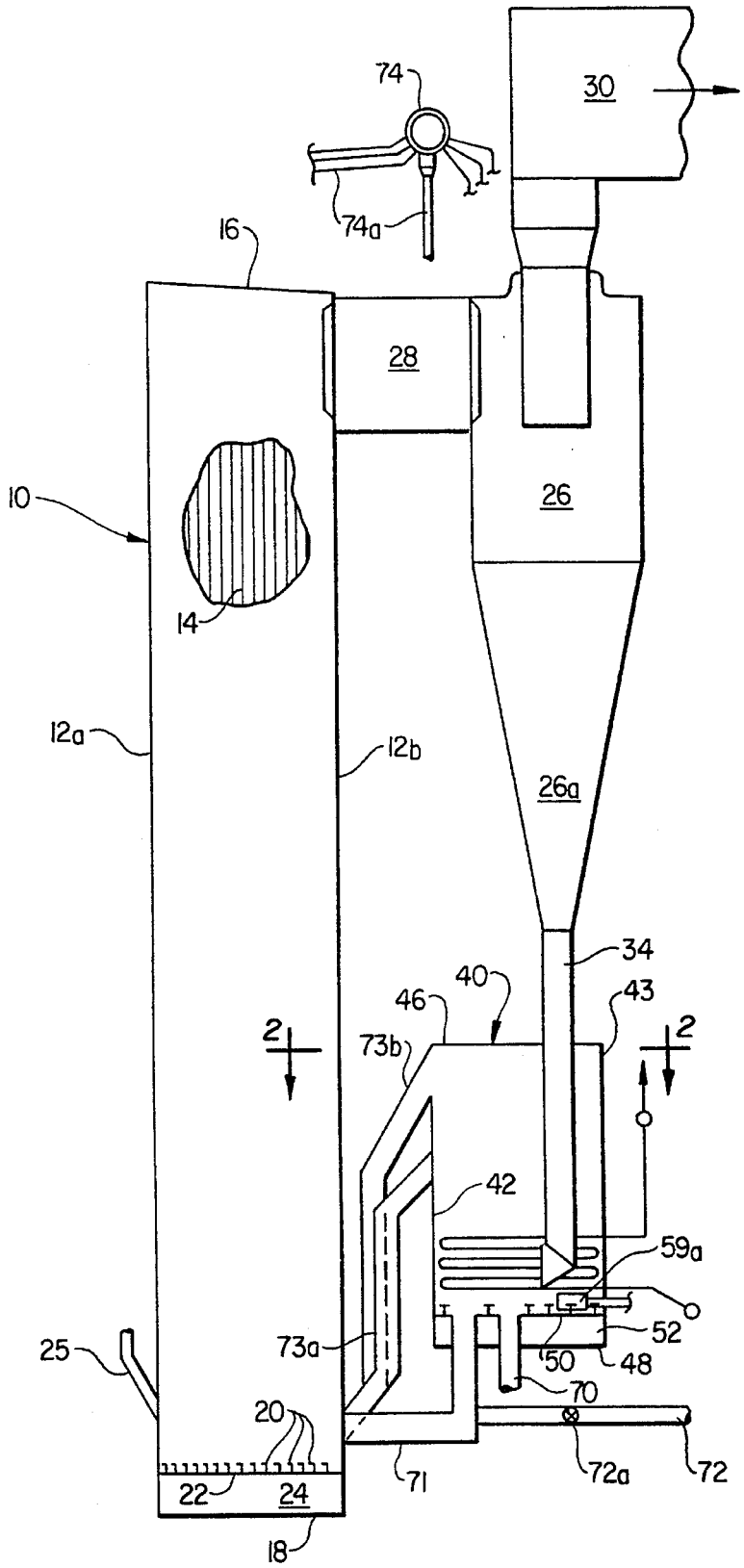
FIG. 1 is a schematic representation depicting the system of the present invention.

The drawings depict the fluidized bed combustion system of the present invention used for the generation of steam and including an upright water-cooled enclosure, referred to in general by the reference numeral 10, having a front wall 12*a*, a rear wall 12*b* and two sidewalls one of which is shown by the reference numeral 14. The upper portion of the enclosure 10 is closed by a roof 16 and the lower portion includes a floor 18.

A plurality of air distributor nozzles 20 are mounted in corresponding openings formed in a plate 22 extending across the lower portion of the enclosure 10. The plate 22 is spaced from the floor 18 to define an air plenum 24 which is adapted to receive air from an external source (not shown) and selectively distribute the air through the plate 22 and to portions of the enclosure 10, as will be described.

A coal feeder system, shown in general by the reference numeral 25, is provided adjacent the front wall 12 for introducing particulate material containing fuel into the enclosure 10. Since the feeder system 25 is conventional it will not be described in any further detail. It is understood that a particulate sorbent material can also be introduced into the enclosure 10 for absorbing the sulfur generated as a result of the combustion of the fuel. This sorbent material may be introduced through the feeder 25 or independently through openings in the walls 12*a*, 12*b*, or 14.

The particulate fuel and sorbent material (hereinafter termed "solids") in the enclosure 10 is fluidized by the air from the plenum 24 as the air passes upwardly through the plate 22. This air promotes the combustion of the fuel in the solids and the resulting mixture of combustion gases and the air (hereinafter termed "flue gases") rises in the enclosure by forced convection and entrains a portion of the solids to form a column of decreasing solids density in the upright enclosure 10 to a given elevation, above which the density remains substantially constant.

A cyclone separator 26 extends adjacent the enclosure 10 and is connected thereto via a duct 28 extending from an outlet provided in the rear wall 12*b* of the enclosure 10 to an inlet provided through the separator wall. The separator 26 includes a hopper portion 26*a* extending downwardly therefrom. Although reference is made to one separator 26, it is understood that one or more additional separators (not shown) may be disposed behind the separator 26. The number and size of separators used is determined by the capacity of the steam generator and economic considerations.

The separator 26 receives the flue gases and the entrained particle material from the enclosure 10 in a manner to be described and operates in a conventional manner to disengage the solids from the flue gases due to the centrifugal forces created in the separator. The separated flue gases, which are substantially free of solids, pass, via through a duct 30 located immediately above the separator 26. The system and method of the present invention are applicable to both an atmospheric circulating fluidized bed in which case the duct 30 would be connected to the heat recovery area as disclosed in the above patent, and to a pressurized circulating fluidized bed in which case the duct 30 would be connected to hot gas cleaning equipment then through an optional topping combustor and finally into a hot gas turbine.

Figure 2:
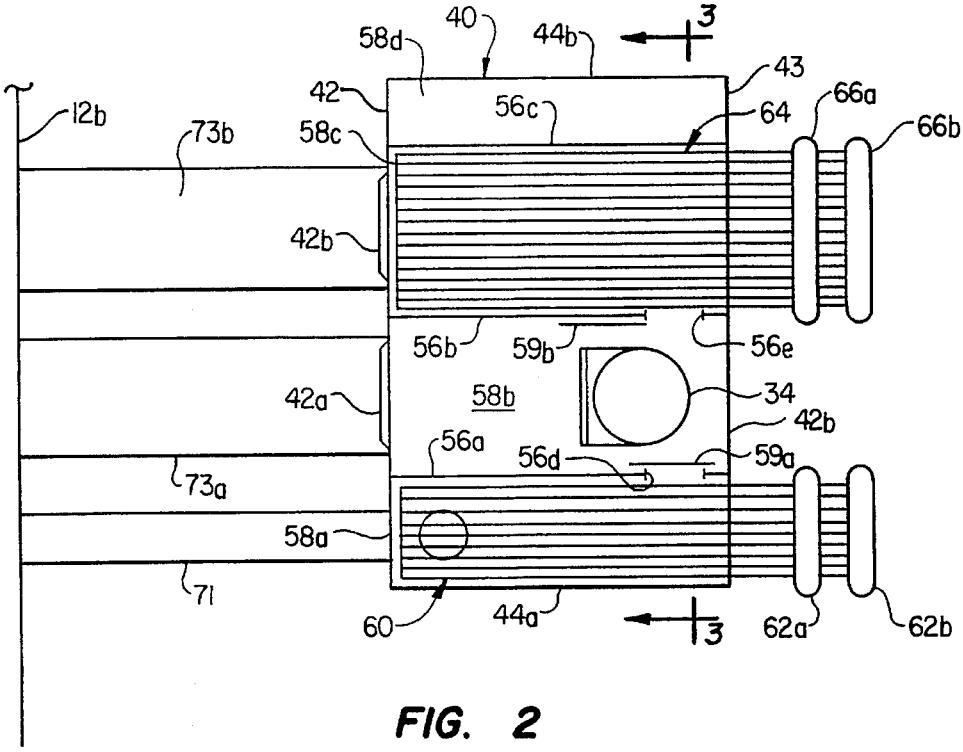
FIG. 2 is an enlarged cross-sectional view taken along the line 2—2 of FIG. 1.
Figure 3:
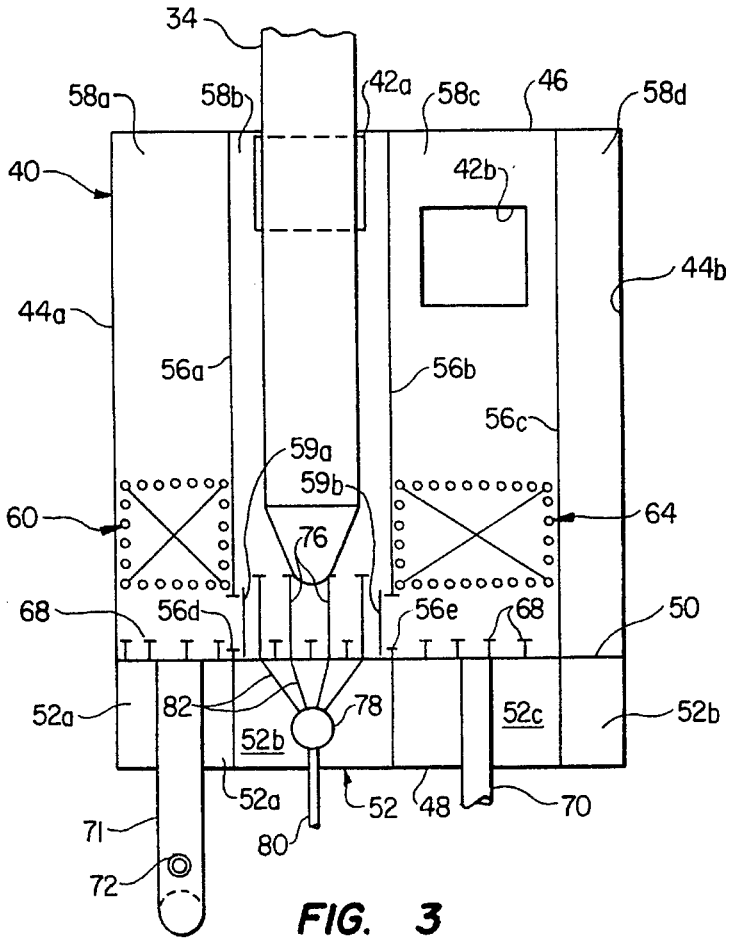
FIG. 3 is a cross-sectional view taken along the line 3—3 of FIG. 2.

The separated solids in the separator 26 pass downwardly, by gravity, into and through the hopper portion 26*a* from which they pass, via a dipleg 34, into a recycle heat exchanger shown in general by the reference numeral 40, provided adjacent the enclosure 10 and below the separator 26. As better shown in FIGS. 2 and 3, the recycle heat exchanger 40 includes a front wall 42, a rear wall 43 and two sidewalls 44*a* and 44*b*. A roof 46 and a floor 48 extend across the upper ends and the lower ends, respectively, of the walls 42, 43, 44*a* and 44*b*. A plate 50 extends across the heat exchanger 40 in a slightly-spaced relation to the floor 48 to define a plenum 52. Three vertical partitions 56*a*, 56*b* and 56*c* extend in a spaced, parallel relation to, and between, the sidewalls 44*a* and 44*b* to define four compartments 58*a*, 58*b* 58*c* and 58*d*. The partitions 56*a*, 56*b* and 56*c* also extend into the plenum 52 to divide it into three sections 52*a*, 52*b* and 56*c* (FIG.3). It is understood that dampers, or the like, (not shown) can be provided to selectively distribute air to the individual plenum sections 52*a*, 52*b* and 52*c*.

Two openings 56*d* and 56*e* are provided in the lower portions of the partition 56*a* and 56*b*, respectively, just above the plate 50, and a pair of sliding gate valves 59*a* and 59*b* are mounted relative to the partitions 56*a* and 56*b*, to control the flow of solids through the openings 56*c* and 56*d* as will be discussed.

A bank of heat exchange tubes, shown in general by the reference numeral 60, are provided in the compartment 58*a* with the respective end portions of each tube extending outwardly through appropriate openings through in the rear wall 43. The ends of each tube are connected to an inlet header 62*a* and outlet header 62*b*, respectively (FIG. 2). Similarly, a bank of heat exchange tubes 64 are provided in the compartment 58*c* and are connected at their respective ends to an inlet header 66*a* and an outer header 66*b*.

As better shown in FIG. 3, a plurality of air discharge nozzles 68 extend upwardly from the plate 50 in each of the compartments 58*a*, 58*b* and 58*c* and are mounted in corresponding openings formed through the plate for receiving air from the plenum sections 52*a*, 52*b* and 52*c* and introducing the air into the compartments 58*a*, 58*b* and 58*c*, respectively.

A drain pipe 70 is provided in the plenum section 52*c* and extends downwardly from the plate 50 and through the floor 48 to discharge solids from the latter compartment.

An L-valve 71 extends downwardly from the plenum section 52*a* and horizontally to an opening formed in the rear wall 12*b* of the enclosure 10 to permit solids from the plenum section 52*a* to be transferred to the enclosure as will be described. This flow of solids is assisted and controlled by an air duct 72 (FIG. 1) communicating with the L-valve 71 for discharging air into the valve. A valve 72*a* is provided in the duct 72 for varying the flow rate of the air discharged into the L-valve for reasons to be described. It is understood that the air duct 72 can be configured to communicate with the L-valve 71 at a plurality of locations or that a plurality of air ducts 72 can be provided for this purpose.

As opening 42*a* (FIG. 3) is provided through upper portion of the front wall 42 of the enclosure 40 which registers with the compartment 58*b*, and an opening 42*b* is provided through the upper portion of the wall 42 in registery with the compartment 58*c*. The opening 42*a* is located an elevation higher than the opening 42*b* for reasons to be described. Two conduits 73*a* and 73*b* (FIG. 2) respectively connect the openings 42*a* and 42*b* to corresponding openings formed in the rear wall 12*b* of the enclosure 10 to permit solids from the compartments 58*a* and 58*c* to be transferred to the enclosure 10 as will be described.

The front wall 12*a*, the rear wall 12*b*, the sidewalls 14, roof 16, as well as the walls defining the separator 26 and the heat recovery enclosure 34 all are formed of membrane-type walls, each of which is formed by a plurality of finned tubes disposed in a vertically extending, airtight relationship with adjacent finned tubes being connected along their lengths. Since this type of construction is conventional it will not be described in any further detail.

A steam drum 74 is located above the enclosure 10 and, although not shown in the drawings, it is understood that a plurality of headers are disposed at the ends of the various walls described above. Also, a plurality of downcomers, pipes, risers, headers etc., some of which are shown by the reference numeral 74*a*, are utilized to establish a steam and water flow circuit including the steam drum 80, the tubes forming the aforementioned water tube walls and the tubes 60 and 64 in the compartments 58*a* and 58*c* of the recycle heat exchanger 40. An economizer (not shown) receives feedwater and discharges it to the drum 80 and the water is passed, in a predetermined sequence through this flow circuitry to convert the water to steam and heat the steam by the heat generated by combustion of the particulate fuel material in the enclosure 10.

In operation, the solids are introduced into the enclosure 10 through the feeder system 25. Air from an external source is introduced at a sufficient pressure into the plenum 24 and the air passes through the nozzles 20 and into the enclosure 10 at a sufficient quantity and velocity to fluidize the solids in the latter section.

A lightoff burner (not shown), or the like, is provided to ignite the fuel material in the solids, and thereafter the fuel material is self-combusted by the heat in the furnace section. The flue gases pass upwardly through the enclosure 10 and entrain, or elutriate, a majority of the solids. The quantity of the air introduced, via the air plenum 24, through the nozzles 20 and into the interior of the enclosure 10 is established in accordance with the size of the solids so that a circulating fluidized bed is formed, i.e. the solids are fluidized to an extent that substantial entrainment or elutriation thereof is achieved. Thus the flue gases passing into the upper portion of the enclosure 10 are substantially saturated with the solids and the arrangement is such that the density of the bed is relatively high in the lower portion of the enclosure 10, decreases with height throughout the length of this enclosure 10 and is substantially constant and relatively low in the upper portion of the enclosure.

The saturated flue gases in the upper portion of the enclosure exit into the duct 28 and pass into the cyclone separator 26. In the separator 26, the solids are separated from the flue gases and the former passes from the separator through the dipleg 34 and into the recycle heat exchanger 40. The clean flue gases from the separator 26 exit, via the duct 30, and pass to a heat recovery section in the case of an atmospheric circulating fluidized bed and to hot gas cleaning equipment in the case of a pressurized circulating fluidized bed.

During normal operation, the sliding gate valve 59*a* is in its closed portion and the valve 59*b* is in its open position as shown in FIG. 2 so that the separated solids from the dipleg 34 enter the compartment 58*b* and pass, via the opening 56*e*, into the compartment 58*c*. Air is introduced into the section 52*c* of the plenum 52 below the compartment 58*c* and is discharged through the corresponding nozzles 68 to fluidize the solids in the compartment 58*c*. The solids in the compartment 58*c* pass in a generally upwardly direction across the heat exchange tubes 64, exit via the opening 42*b* into the conduit 73*b*, and pass back into the enclosure 10. Although not normally necessary, the solids can be discharged from the compartment 58*c*, via the drain pipe 70, as needed. During this normal operation, fluidizing air is not introduced into the air plenum section 52*a* associated with the compartment 58*a*, and since the opening 42*a* in the wall 42 is at a greater height than the opening 42*b*, very little, if any, flow of solids occurs from compartment 58*b* directly to the enclosure 10.

During initial start up, the sliding gate valve 59*b* is closed and the fluidizing air to the plenum section 52*b* is turned on while the air flow to the section 52*c* is turned off. The solids in the compartment 58*c* thus slump and therefore seal this compartment from further flow. The solids from the dipleg 34 pass into the compartment 58*b* and the air passing into the latter compartment from the plenum section 52*b* forces the material upwardly and outwardly through the opening 42*a*, and the conduit 73*a* to the enclosure 10. Since the compartment 58*b* does not contain heat exchanger tubes, it functions as a direct bypass, or a "seal pot", so that start up operation can be achieved without exposing the heat exchanger tubes 64 to the hot recirculating solids.

During low-load operation, or when the duty of the recycle heat exchanger 40 is relative low or requires modulation, the sliding gate valve 59*a* is opened to expose the opening 56*d* in the partition 56*a* and air is introduced into the plenum section 52*a*. This induces solids flow from the compartment 58*b*, through the opening 56*d*, into the compartment 58*a*, and across the heat exchange tubes 60 to cool the solids before they are discharged through the L-valve 71. During this operation any air flow through the plenum section 52*c* is terminated, and the sliding gate valve 59*b* is closed, as needed. Air can be introduced, via the air duct 72, into the L-valve 71, to promote the solids flow from the compartment 58*a* to the furnace 10. Since the air flow from the duct 72 into the L-valve 71 is variable, by operation of the valve 72*a*, the duty of the recycle heat exchanger 40 can be modulated to meet varying design criteria.

The compartment 58*d* is provided for accommodating any additional heat exchange tubes to remove additional heat from the solids as might be needed.

Fluid, such as feedwater, is introduced to and circulated through the flow circuit described above in a predetermined sequence to convert the feedwater to steam and to reheat and superheat the steam. To this end, the heat removed from the solids by the heat exchanger tubes 60 and 64 in the compartments 58*a* and 58*c* can be used to provide reheat or additional superheat.

Another technique of selectively controlling the flow of solids through and between the compartments 58*a*, 58*b* and 58*c* is contemplated. According to this technique, the nozzles 68 in the compartment 58*b* are replaced by a plurality of nozzles 76 (FIG. 3) which extend above the height of the openings 56*d* and 56*e*. An air manifold, or header 78 receives air from an air duct 80 and distributes the air to the nozzle 76 by a corresponding number of air ducts 82. Thus, air introduced into the air duct 80 would be discharged into the compartment 52*b*, via the nozzle 76, at a height greater than the height of the openings 56*d* and 56*e*. As a result, the solids in the compartment 56*b* extending below the upper ends of the nozzles 76 would not be fluidized but rather would tend to slump in the latter compartment, while the solids extending above the nozzles 76 would be fluidized and thus flow upwardly through the compartment 58*b* and out the opening 42*a* in the wall 42 for passage, via the conduit 73*a*, to the enclosure 10. Thus very little, if any, solids flow from the compartment 58*b* into the compartments 58*a* and 58*c* through the openings 56*d* and 56*e*, respectively, would occur. If air flow into the air duct 80, and therefore into the compartment 58*b*, is shut off, and air is passed into the plenum sections 52*a*, 52*b* or 52*c*, the latter air would induce the flow of solids from the compartment 58*b* to the compartments 58*a* or 58*c* as described above.

Thus, use of the nozzles 76 enables the solids flow between the compartments 58*a*, 58*b* and 58*c* to be selectively controlled. It is understood that the nozzles 76 can be used in place of the valves 59*a* and 59*b* or in addition thereto.

Several advantages result in the system of the present invention. For example, heat is removed from the separated solids exiting from the separator 26 before they are reintroduced to the enclosure 10, without reducing the temperature of the flue gases. Also, the separated gases are at a sufficient temperature to provide significant heating of the system fluid while the recycle heat exchanger can function to provide additional heating such as might be needed in a reheat cycle. Also the recycled solids can be passed directly from the dipleg 34 to the enclosure 10 during start-up or low load conditions prior to establishing adequate cooling steam flow to the tubes 64 in the compartment 58*c*. Further, selective flow of the solids between the compartments 58*a*, 58*b* and 58*c* in the recycle heat exchanger enclosure 40 is permitted depending on the particular operating conditions. Also, during low load operation, or when the duty of the recycle heat exchanger 40 is relative small or requires modulation, the solids flow from the heat exchanger 40, through the L-valve 71 and the furnace 10 can be modulated by varying the air flow from the duct 72.

It is understood that several variations may be made in the foregoing without departing from the scope of the present invention. For example, the heat removed from the solids in the compartment 58*c* can be used for heating the system fluid in the furnace section or in an economizer, etc. Also, other types of beds may be utilized in the enclosure 10 such as a circulating transport mode bed with constant density through its entire height or a bubbling bed, etc. Also a series heat recovery arrangement can be provided with superheat, reheat and/or economizer surface, or any combination thereof. Further, the number and/or location of the bypass channels in the recycle heat exchanger 40 can be varied. Still further, sorbent material may be introduced into the enclosure 10 via the conduits 73*a* and 73*b*.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluidized bed combustion system comprising an enclosure, means in said enclosure for supporting a fluidized bed of particulate material including fuel, separating means for receiving a mixture of flue gases resulting from the combustion of said fuel and entrained particulate material and separating said entrained particulate material from said flue gases, three compartments disposed adjacent said enclosure, means for discharging said separated material from said separating means to one of said compartments, means for selectively permitting the flow of said separated material from said one compartment to the other compartments, means for passing a cooling medium in heat exchange relation to said separated material in said other compartments for cooling said material, a first duct connecting said one compartment to said enclosure for passing the separated material in said one compartment directly back to said enclosure, two additional ducts respectively connecting said other compartments to said enclosure for passing said separated material from said other compartments back to said enclosure, means for introducing air into one of said additional ducts for promoting the flow of said separated material from the compartment associated with said one additional duct to said enclosure, and means for varying the flow of said air to vary the flow of said material through said one additional duct.

2. The system of claim 1 wherein said permitting means comprises two valves for respectively controlling the flow of said material into said other compartments from said one compartment.

3. The system of claim 2 wherein each of said valves is movable between an open position in which said material flows from said one compartment to the compartment associated with the valve, and a closed position in which said material flows from said one compartment directly back to said enclosure or to the other compartment not associated with the valve.

4. The system of claim 1 wherein said permitting means comprising means for selectively introducing air to said one compartment to control the flow of said material to said other compartments.

5. The system of claim 1 wherein one of said additional ducts is in the form of an L-valve.

6. The system of claim 1 wherein said one additional duct is connected to the floor of its corresponding other compartment.

7. The system of claim 1 wherein said one compartment extends between said other compartments.

8. The system of claim 1 further comprising means for selectively introducing air to each of said compartments to fluidize the material therein and permit said flow of material between compartments.

9. The system of claim 1 wherein at least a portion of the walls of said enclosure are formed by tubes, and further comprising fluid flow circuit means for passing fluid through said tubes to transfer heat generated in said furnace section to said fluid.

10. A method of operating a fluidized bed combustion system, comprising the steps of supporting a fluidized bed of particulate material including fuel in an enclosure, combusting said fuel material in said enclosure, separating the entrained particulate material from the flue gases resulting from said combustion, passing the separated material to one compartment of a recycle heat exchanger, selectively passing said material from said one compartment back to said enclosure or to two other compartments of said heat exchanger, cooling said material in said other compartments, passing said cooled material from both of said other compartments back to said enclosure, and introducing air to the flow of cooled material passing from one of said other compartments to said enclosure to promote the flow of said cooled material from said one other compartment to said enclosure, and varying said step of introducing to vary the rate of flow of said cooled material from said one other compartment to said furnace.

11. The method of claim 10 wherein said step of selectively passing comprises the step of introducing air into said one compartment for passing said material directly to said furnace or introducing air to said other compartments for passing said material from said first compartment to said other compartments.

12. The system of claim 10 wherein the material in said one other compartment passes from the floor of said latter compartment to said enclosure.

* * * * *